US006871807B2

(12) United States Patent
Rossi, Jr.

(10) Patent No.: US 6,871,807 B2
(45) Date of Patent: Mar. 29, 2005

(54) MOBILE IMPACT CRUSHER ASSEMBLY

(76) Inventor: Robert R. Rossi, Jr., 2227 Beaucatcher La., Charlotte, NC (US) 28270

( * ) Notice: Subject to any disclaimer, the term of this patent is extended or adjusted under 35 U.S.C. 154(b) by 185 days.

(21) Appl. No.: 10/245,483

(22) Filed: Sep. 17, 2002

(65) Prior Publication Data

US 2004/0050984 A1 Mar. 18, 2004

(51) Int. Cl.[7] ..... B02C 13/26

(52) U.S. Cl. ..... 241/101.72; 241/189.1; 241/286

(58) Field of Search ..... 241/101.72, 101.73, 241/189.1, 286

(56) References Cited

U.S. PATENT DOCUMENTS

| | | | | |
|---|---|---|---|---|
| 3,959,897 | A | 6/1976 | May | |
| 4,140,284 | A | 2/1979 | Jöbkes | |
| 4,361,289 | A | 11/1982 | Georget et al. | |
| 4,607,799 | A * | 8/1986 | Currie | 241/101.72 |
| 4,899,942 | A | 2/1990 | Böhringer | |
| 5,259,692 | A | 11/1993 | Beller et al. | |
| 5,655,719 | A | 8/1997 | Getz | |
| 5,749,530 | A | 5/1998 | Nakayama et al. | |
| 5,887,810 | A | 3/1999 | Maruyama | |
| 5,890,666 | A | 4/1999 | Folling et al. | |
| 5,911,373 | A | 6/1999 | Reid | |
| 6,237,865 | B1 | 5/2001 | Luttermann et al. | |
| 6,311,821 | B1 | 11/2001 | Douglas | |

FOREIGN PATENT DOCUMENTS

| | | |
|---|---|---|
| DE | 1022082 | 1/1958 |
| DE | 20112111 | 1/2002 |
| EP | 0965697 A1 | 12/1999 |
| EP | 1138834 A2 | 10/2001 |
| WO | WO9845043 | 10/1998 |

OTHER PUBLICATIONS

Japanese Patent Abstract 10168927, Jun. 23, 1998.
International Search Report, Sep. 16, 2003.
Japanese Abstract 11033420, Feb. 9, 1999.
Japanese Abstract 09088355, Mar. 31, 1997.
International Search Report, Jan. 16, 2004.
Operation and Maintenance Instructions IMCO–022, Cedarapids, Roller Bearing Jaw Crusher Model 2036 and 2236, Iowa Manufacturing Company, Cedar Rapids, Iowa, USA 1962.
Cedarapids Parts Manual, Iowa Manufacturing Company, Cedar Rapids, Iowa, USA 52402.
Operating Instructions for Cedar Rapids Roller Bearing Crushers.
Hazemag Primary Impactors, Hazemag USA, Inc.
http://www.ideachip.fi/en/allu/sm/principle.html.
http://www.gannonukltd.co.uk/twister.htm.

* cited by examiner

*Primary Examiner*—Mark Rosenbaum
(74) *Attorney, Agent, or Firm*—Dority & Manning, P.A.

(57) ABSTRACT

A mobile impact crusher assembly for crushing objects is provided. The mobile impact crusher assembly includes a frame that is configured for attachment to a vehicle. The vehicle is capable of moving the mobile impact crusher assembly and at least partially rotating the mobile impact crusher assembly. The frame is configured to hold objects that are to be crushed. The frame is also configured to allow for crushed to be removed. A rotor is rotationally mounted on the frame. The rotor is configured to rotate and crush objects that are held by the frame.

30 Claims, 10 Drawing Sheets

MOBILE IMPACT CRUSHER ASSEMBLY

BACKGROUND

One important use of impact crushers is in assisting in the cleaning up and the reduction of waste in our society. Impact crushers are capable of recycling used concrete, asphalt, brick, cinder block, demolition debris, glass, and any other substances that are hard and brittle. Impact crushers are also used for crushing rock and other natural substances. The recycling of these materials is an increasingly important aspect in the cleaning and preservation of our environment. Impact crushers may reduce objects from a larger to a smaller size in order to recycle and/or store waste material.

An impact crusher uses a diesel/hydraulic system in order to operate. It is often the case that other pieces of machinery that work in conjunction with the impact crusher to reduce material from a base size to the desired size also have their own diesel/hydraulic systems. For instance, an excavator may load material into the impact crusher, and a screening device may be present to reduce the size of the material that is ejected from the impact crusher. Further, a conveyor and/or feeder system is commonly employed to transport material to and from the impact crusher. In addition to the increased cost of running these separate systems, operation of such numerous diesel/hydraulic systems also negatively impacts the environment.

An impact crusher is a device that typically includes a frame that defines an enclosure wherein material that is to be crushed is dropped vertically into the frame. A rotor is rotationally mounted within the frame and turns about a horizontal axis. The rotor is often provided with one or more crushing bars that contact the material that is dropped into the frame. The crushing bars impact the material and forces the material against either a wall of the frame or against one or more impact plates that are positioned within the frame. The impact plates are positioned for receiving the thrown material and are provided with a dampening member in order to reduce shock to the frame. The material is crushed into smaller objects by being thrown against these impact plates and is moved into a different section of the frame. Here, the materials again may be contacted by a crushing bar of the rotor and thrown against one or more impact plates to further reduce the size of the crushed material. Eventually, the material is discharged from the frame and is deposited either into a pile or onto a conveyor system which transports the crushed objects to be further processed.

Some impact crushers are provided with an adjusting mechanism that may be used in order to adjust the distance between the impact plates and the rotor. Such an adjustment of this distance between the impact plates and the rotor typically occurs when the impact crusher assembly is turned off. By varying the distance between the rotor and the impact plates, an adjustment of the size of the crushed objects may be realized. Additionally, this adjustment may be done in order to maintain the desired output size of the crushed objects since the impact plates change size naturally due to wear through normal use.

Impact crushers may be designed in various formats to produce the crushed objects. For instance, some impact crushers are designed such that the distance between the crushing bars of the rotor and the impact plates is very small, resulting in a crushing of the material that is more akin to grinding than to shattering the object by being thrown against an impact plate.

An impact crusher is typically employed at construction sites. These construction sites can be, for instance, where buildings are being demolished or where roads are being built or repaired. Material from these construction sites may be placed into the impact crusher, crushed into a suitable size by the impact crusher and a further processing machine, and then reused at this particular construction site. This allows for a quick, inexpensive supply of needed materials along with the reduction of waste to the environment.

Impact crushers crush hard materials. In fact, impact crushers may crush materials that contain steel. It is sometimes the case that material that contains steel when crushed by an impact crusher separates from the steel upon being crushed. An example of some material that may be crushed by an impact crusher includes: rock, rubble, stone, boulders, concrete, asphalt, brick, block, glass, demolition debris, and the like.

In some impact crushers, the most efficient mode of operation of the impact crusher is to keep the crushing section full of material. Material may be fed into the crushing section of the impact crusher by, for instance, a conveyor and/or feeder.

Impact crushers are stationary devices that typically are positioned at single locations in a construction site. Other pieces of machinery must be used in order to provide material to the impact crusher to be crushed. Additional equipment must be employed in order to remove the material that is ejected from the impact crusher, and must be used to further process the material into a desired size. Additionally, further equipment may be required in order to transport the ejected material from the impact crusher into a desired location. All of the equipment and/or systems used to transport material to and from the impact crusher, in addition to further process the material, require a source of power. Also, these systems must be maintained and often operated by a user. Elimination of these systems would prove beneficial in that less energy, man power, and/or power sources would be needed to complete the process.

SUMMARY

The present invention improves upon previous impact crushers by providing for a mobile impact crusher assembly that can be attached to a piece of construction equipment such as an excavator. Additionally, the present invention also improves upon previous impact crushers by providing for a single pass mobile impact crusher assembly that is powered by the vehicle onto which it is attached. Such a configuration reduces the number of diesel/hydraulic systems that must be employed in the crushing of materials, along with a reduction in the amount of equipment that must be employed in reducing material to a desired size. The current impact crusher may dig and load objects therein in one orientation and crush and then deposit the crushed material in another orientation. Additionally, other benefits may be realized as described herein.

Various features and advantages of the invention will be set forth in part in the following description, or may be obvious from the description, or may be learned from practice of the invention.

The present invention provides for a mobile impact crusher assembly that is used for crushing objects. The assembly includes a frame that defines an enclosure with an exterior surface and an interior space with an inlet opening to said interior space. An outlet opening is disposed generally opposite the inlet opening. The frame defines a holding section in the interior space adjacent to the inlet opening. The frame further defines a crushing section in the interior space that communicates with the holding section and the outlet opening. The frame has a connection member configured for pivotal attachment to a vehicle. The connection member is carried by the exterior surface of the frame. The vehicle may be, for instance, an excavator. A rotor is rotationally mounted relative to the frame and is disposed in the interior space. The rotor rotates and crushes objects that are held in the frame. The present invention also provides for a mobile impact crusher assembly where at least one impact plate is carried on the frame. Further, the rotor may have one or more crushing bars carried thereon. The crushing bars impact the objects and hurl the objects against the impact plates. The objects are broken apart by a combination of the rotor and the impact plates.

In one exemplary embodiment of the present invention, the rotor may be rotationally driven by a driving mechanism. The driving mechanism may be a hydraulic motor that is directly coupled to a shaft of the rotor. Further, the driving mechanism in other exemplary embodiments may be a pulley and V-belt arrangement. Further, in another exemplary embodiment, the driving mechanism includes a first frictional engaging member that is connected to the rotor shaft and is driven by a second frictional engaging member that engages and turns the first frictional engaging member. The driving mechanism may be configured to be run by a hydraulic source of the vehicle or may have its own separate diesel/hydraulic source located on the mobile impact crusher assembly.

The present invention also includes an exemplary embodiment of the mobile impact crusher assembly as described above which further includes a screen attachment that is attached to the vehicle. Crushed objects from the mobile impact crusher assembly may be deposited into the screen attachment for further processing.

DETAILED DESCRIPTION

Figure 1:
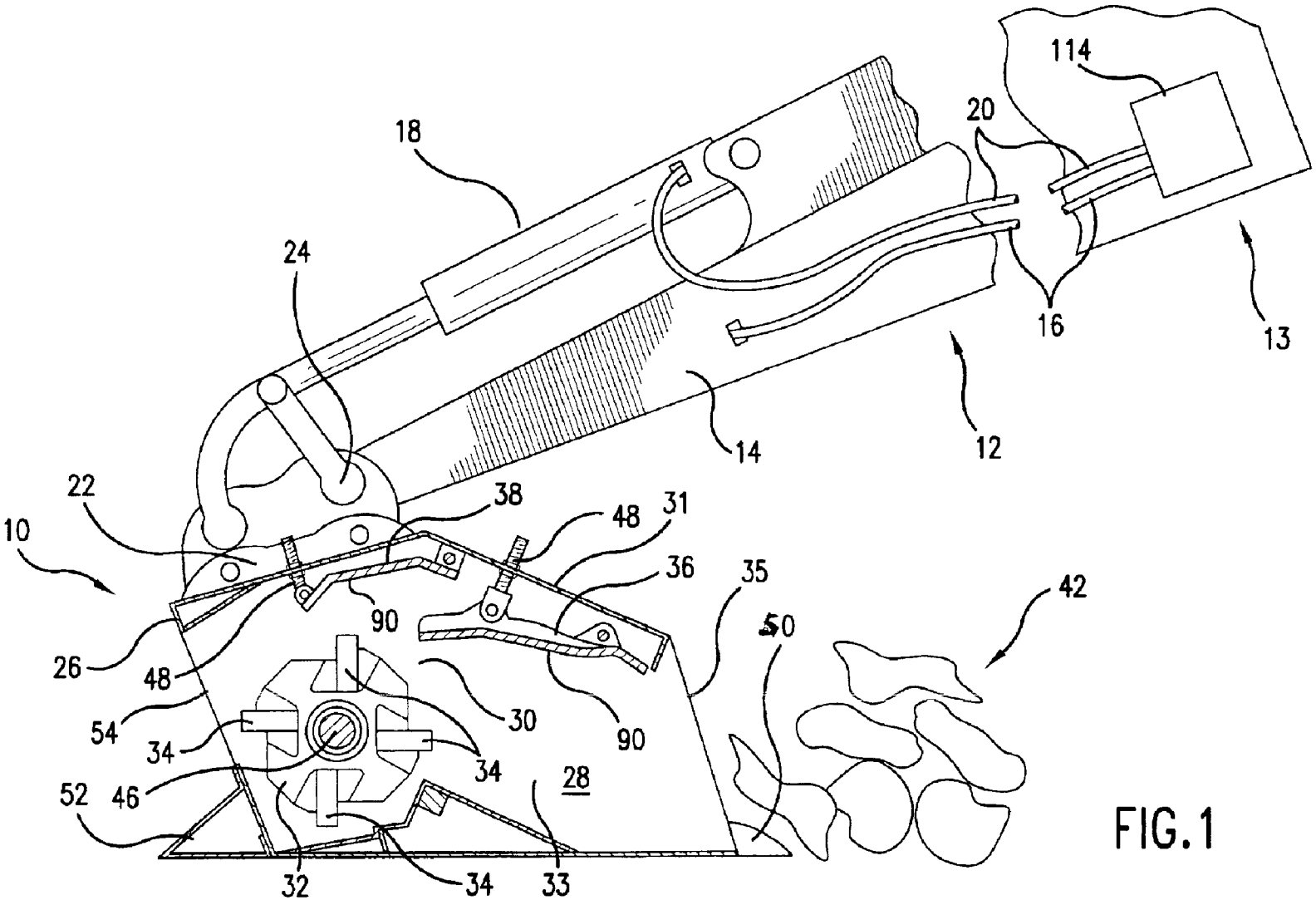
FIG. 1 is a side elevation view of a mobile impact crusher assembly in accordance with the present invention. The mobile impact crusher assembly is shown attached to an arm of a vehicle (shown schematically) and is preparing to receive objects into a holding section.

Reference will now be made in detail to embodiments of the invention, one or more examples of which are illustrated in the drawings. Each example is provided by way of explanation of the invention, and is not meant as a limitation of the invention. For example, features illustrated or described as part of one embodiment can be used with another embodiment to yield still a third embodiment. It is intended that the present invention include these and other modifications and variations.

Referring now to the drawings, FIG. 1 shows a mobile impact crusher assembly 10 in accordance with an exemplary embodiment of the present invention. The mobile impact crusher assembly 10 includes a frame 26 that has a connection member 22 located thereon. The frame 26 defines an enclosure with an exterior surface 31 and an interior space 33. An inlet opening 35 allows access into the interior space 33. An outlet or discharge opening 54 is located opposite from the inlet opening 35. The frame 26 defines a holding section 28 adjacent to the inlet opening 35. Also defined by the frame 26 is a crushing section 30 that is in communication with the holding section 28 and the outlet opening 54.

The connection member 22 is configured to be able to receive a member of a vehicle in order to allow for the mobile impact crusher assembly 10 to be selectively connected and selectively disconnected from the vehicle. For instance, a series of bolts may be provided in order to allow for attachment and disconnection of the mobile impact crusher assembly 10 to the vehicle. However, it could be the case that the connection member 22 provides for a permanent connection between the mobile impact crusher assembly 10 and the vehicle.

The mobile impact crusher assembly 10 may be configured to be connected to any type of machine used in the excavation industry. Examples include a hydraulic excavator, a loader, a shovel, and/or a crane. The mobile impact crusher assembly 10 may replace the vehicle's bucket and may also be powered by the vehicle onto which it is attached. The mobile impact crusher assembly 10 may be used as a bucket and transfer device, as well as being a crusher that exhibits a controlled form of crushing. In order words, it may be adjusted to regulate the output size of crushed material. This could be significant in that different States require different sized material specifications for base material as well as other products.

As shown in FIG. 1, the vehicle onto which the mobile impact crusher assembly 10 is attached is an excavator 12. More particularly, the mobile impact crusher assembly 10 is connected to an excavator arm 14. A pivot 24 is provided on a portion of the excavator arm 14. A hydraulic cylinder 18 is also provided on the excavator arm 14. Actuation of the hydraulic cylinder 18 results in a corresponding rotation of the mobile impact crusher assembly 10 about the pivot 24. Such a pivoting arrangement is commonly known in the art. A hydraulic cylinder line 20 feeds hydraulic fluid to the hydraulic cylinder 18. Although the exemplary embodiment shown in FIG. 1 makes use of hydraulics in order to move and rotate the mobile impact crusher assembly 10, it is to be understood that other mechanisms are possible in accordance with the present invention. For instance, a gear train arrangement could be used in order to provide the required movement and/or rotation of the mobile impact crusher assembly 10.

The mobile impact crusher assembly 10 includes a rotor 32 that is used to crush objects 42. The mobile impact crusher assembly 10 is designed to process objects 42 that may be hard materials and/or recyclable type materials. For instance, the objects 42 may be concrete, asphalt, brick, cinder block, and/or demolition debris. Additionally, hard and brittle objects such as rock or glass may also be crushed. The rotor 32 is provided with at least one and desirably more than one crushing bar 34, which are disposed about the outer circumference of the rotor 32. The rotor 32 may hold the crushing bars 34 with the use of wedges, bolts, or through the unique shape of the crushing bar 34. The crushing bars 34 may be replaced once they begin to exhibit wear throughout normal operation of the mobile impact crusher assembly 10. Many variations of the rotor 32 are possible under the scope of the present invention. For instance, instead of having crushing bars 34, the rotor 32 may be provided with a series of grinding teeth that are used to crush the objects 42. Additionally, any number of crushing bars 34 may be employed on the rotor 32. One such alternate arrangement of the rotor 32 is disclosed in U.S. Pat. No. 4,140,284 to Jöbkes and this patent is incorporated herein in its entirety for all purposes.

It will be appreciated that under the scope of the present invention, various ways of driving the rotors 32 can be employed. The rotor 32 is rotatably mounted onto a rotor shaft 46, the rotor 32 rotating relative to the frame 26. The rotor shaft 46 may be secured onto the frame 26 by two outboard pillow block bearings (not shown) which are carried on the outside of the frame 26. Rotation of the rotor 32 may be obtained by a driving mechanism as will be later explained. The driving mechanism may be run by its own source of power which may be, for instance, a diesel/hydraulic system that is mounted on the frame 26. Such a diesel/hydraulic system 110 is shown schematically on the frame 26 in FIGS. 5 and 6. Additionally, the driving mechanism can be run from the hydraulic system of the vehicle. As schematically shown in FIG. 1 for instance, a diesel/hydraulic system 114 may supply hydraulic fluid through a hydraulic line 16 that is run through the excavator arm 14 and into the driving mechanism to eventually turn the rotor 32.

The mobile impact crusher assembly 10 also includes at least a first impact plate 36 and desirably a second impact plate 38. Each impact plate 36, 38 is mounted on the interior of the frame 26. The first and second impact plates 36 and 38 aid in preventing the frame 26 from being damaged by the objects 42 thrown from the rotor 32. The mobile impact crusher assembly 10 functions by having the rotor 32 rotate so that the crushing bars 34 strike objects 42 and hurl the struck objects against the impact plates 36 and 38. This action breaks up the objects 42 and reduces them to a smaller desired size. The first and second impact plates 36 and 38 are attached to the frame via spindles 48. The plates 36 and 38 may also be pivotally or non-pivotally mounted onto the frame 26. The plates 36 and 38 are mounted such that they have some yield when struck by the objects 42 thrown by the crushing bars 34.

Various mechanisms may be employed in order to absorb the force of the thrown objects 42. For instance, dampening springs may be used to absorb the forces imported onto the plates 36 and 38. Additionally, a fluid dampening mechanism such as a hydraulic cylinder may be employed in order to absorb this force. Such a dampening mechanism may be employed on a spindle 48.

The plates 36 and 38 may each be provided with a hardened surface 90 in order to provide for a long life of the first and second impact plates 36 and 38, and consequentially minimize the number of times the plates 36 and 38 need to be replaced. However, it is to be understood that in all mobile impact crusher assemblies 10, the parts will always suffer some degree of wear and will need to be replaced. However, in lieu of simply replacing the first and second impact plates 36 and 38, the distance between the first and second impact plates 36 and 38 and the rotor 32 may be adjusted. By moving the distance of the plates 36 and 38 relative to the rotor 32 and the crushing bar 34, one may either vary the size of the crushed objects that are expelled from the mobile impact crusher assembly 10, or may compensate for the wear that is imparted onto the harden surfaces 90. Placing the plates 36 and 38 farther from the crushing bars 34 results in larger crushed objects and vice versa. The construction of impact plates are known in the art, for instance please see U.S. Pat. No. 4,140,284 by Jöbkes that shows an alternate configuration of the impact plates, spindles, and rotor.

Figure 2:
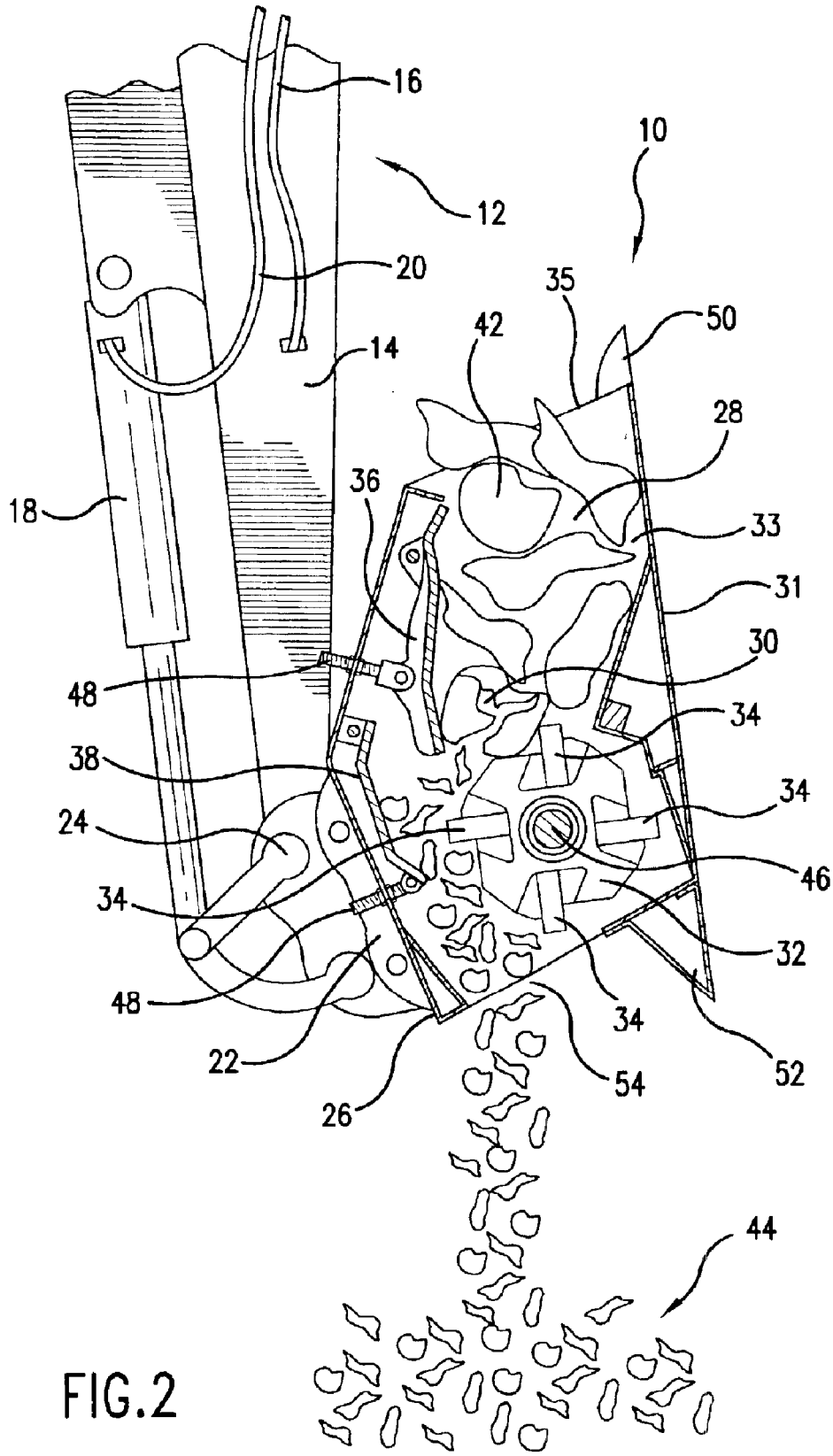
FIG. 2 is a side elevation view of the mobile impact crusher assembly shown in FIG. 1. The view shows the objects being crushed by a rotor and impact plates of the mobile impact crusher assembly, and reduced objects being deposited therefrom.

The mobile impact crusher assembly 10 is manipulated by the excavator arm 14 such that it may dig into rock or other objects 42. Teeth 50 and 52 are provided on either end of the frame 26 in order to, among other things, aid in the initial digging and tearing of the objects 42, or to help scrape them into a holding section 28 of the mobile impact crusher assembly 10. Once the mobile impact crusher assembly 10 has been manipulated such that objects 42 are placed into the holding section 28, the objects 42 may then be reduced by the mobile impact crusher assembly 10. Referring now to FIG. 2, it can be seen that once the objects 42 are placed into the holding section 28, the mobile impact crusher assembly 10 may be manipulated by the excavator arm 14 such that the mobile impact crusher assembly 10 is rotated approximately 90° relative to the position shown in FIG. 1. This tilting allows the objects 42 to fall from the holding section 28 into the crushing section 30. The rotor 32 is rotated, and the crushing bars 34 impact the objects 42 such that they are hurled against the first and second impact plates 36 and 38.

The crushing of the objects 42 takes place in a crushing section 30 of the mobile impact crusher assembly 10. The objects 42 are reduced to a first size upon contact with the first impact plate 36, and are reduced to a subsequent smaller size upon their impact against the second impact plate 38. The reduced objects 44 fall through the mobile impact crusher assembly 10 due to a combination of gravity and/or the dynamic forces imparted upon the reduced objects 44 by the rotor 32 and the impact plates 36 and 38. The reduced objects 44 are discharged from the mobile impact crusher assembly 10 through a discharge opening 54. The reduced objects 44 then fall into either a stock pile or some other vehicle or area that is immediately below the mobile impact crusher assembly 10. Although shown as being in a substantially vertical orientation, it is to be understood that the mobile impact crusher assembly 10 may function in orientations other than those disclosed in FIGS. 1 and 2.

Figure 3A:
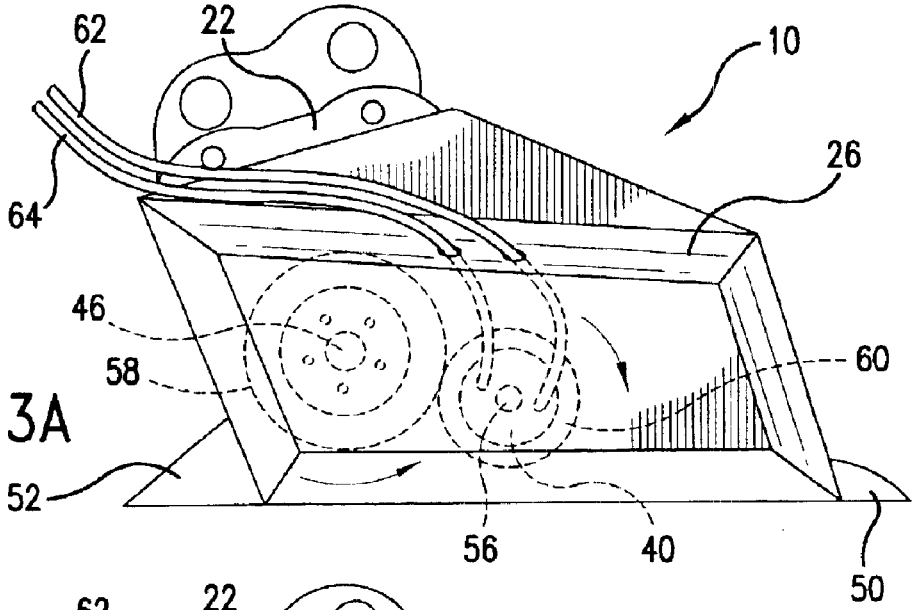
FIG. 3A is a side elevation view of an exemplary embodiment of a mobile impact crusher assembly in accordance with the present invention. The view shows a driving mechanism being a first frictional engaging member engaging a second frictional engaging member that is driven by a motor.
Figure 5:
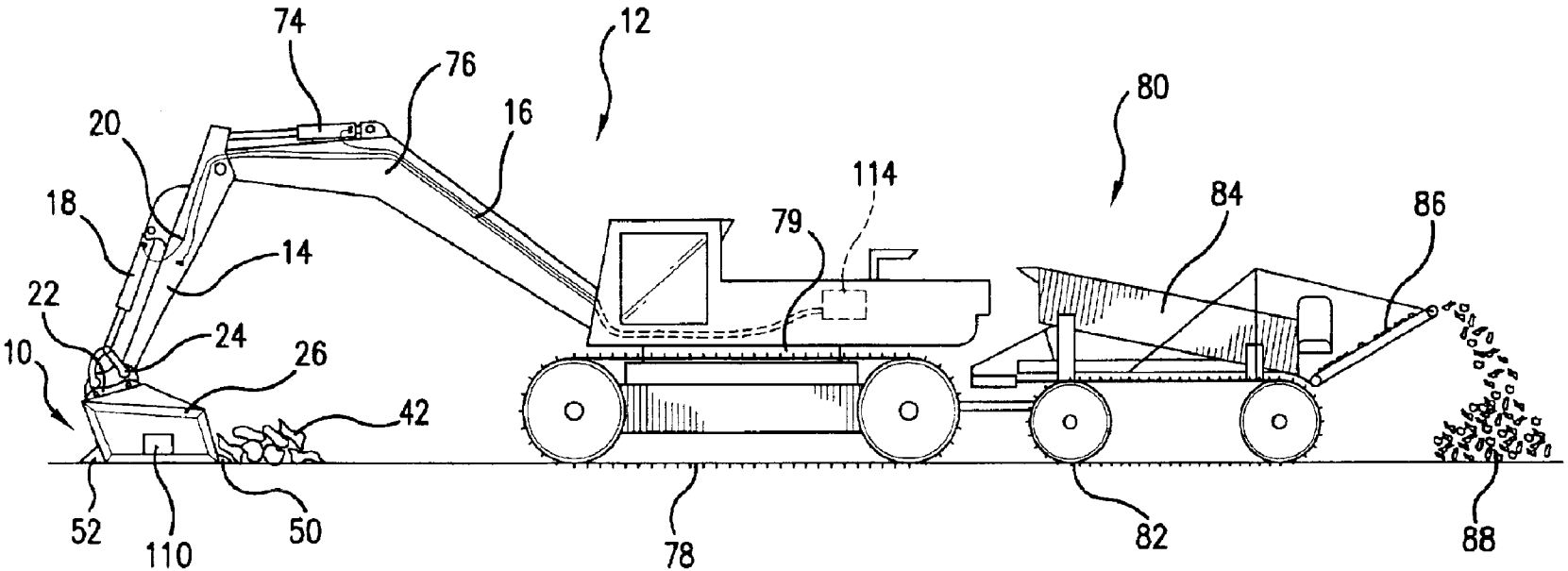
FIG. 5 is a side elevation view of an exemplary embodiment of the mobile impact crusher assembly being connected to an arm of an excavator. The excavator is attached to a screener that may further process reduced objects that are crushed by the mobile impact crusher assembly.

The driving mechanism 40 is shown in more detail in FIG. 3A. This particular configuration of the driving mechanism 40 includes a first frictionally engaging member 58 and a second frictionally engaging member 60. The frictionally engaging members 58 and 60 may be, for instance, a first rubber tire 58 and a second rubber tire 60. The second rubber tire 60 is driven by a motor 56 that receives power via an input power line 62. The motor 56 can be a hydraulic motor 56 that is mounted on the frame 26 and is powered by a hydraulic input line 62 from the vehicle. A hydraulic output line 64 runs from the hydraulic motor 56 through the frame, and back to the vehicle. The first rubber tire 58 is engaged by the second rubber tire 60 such that rotation of the second rubber tire 60 causes a corresponding rotation of the first rubber tire 58. The first rubber tire 58 is fixed to rotate with the rotor shaft 46. Therefore, rotation of the first rubber tire 58 causes a rotation of the rotor shaft 46 which subsequently causes rotation of the rotor 32 (as shown in FIGS. 1 and 2). Although shown as being hydraulically powered, it is to be understood that the first and second rubber tire 58 and 60 arrangement shown in FIG. 3A may be powered by other means. For instance, an electric motor 56 may be coupled to the second rubber tire 60 and may drive the second rubber tire 60 in much the same way as the hydraulic motor 56. Additionally, it is to be understood that the hydraulic lines 62 and 64 from and to the vehicle do not need to be present in other exemplary embodiments of the present invention. For instance, the hydraulic motor 56 may be powered by its own diesel/hydraulic system 110 that is contained on the frame 26, as shown in FIG. 5 or elsewhere in other exemplary embodiments.

When the first and second rubber tires 58 and 60 are inflated they will press against each other in order to transmit motion of one to the other. The frame 26 may be specially reinforced in the section surrounding the drive mechanism 40 in order to protect the drive mechanism 40 and the associated bearings. By changing the diameter of the tires 58 and 60 and/or other components of the drive mechanism 40 as used in other exemplary embodiments of the present invention, as well as the hydraulic pressure of the drive mechanism 40 and/or the RPM of the rotor 32, various output sizes of the reduced objects 44 may be attained.

Figure 3B:
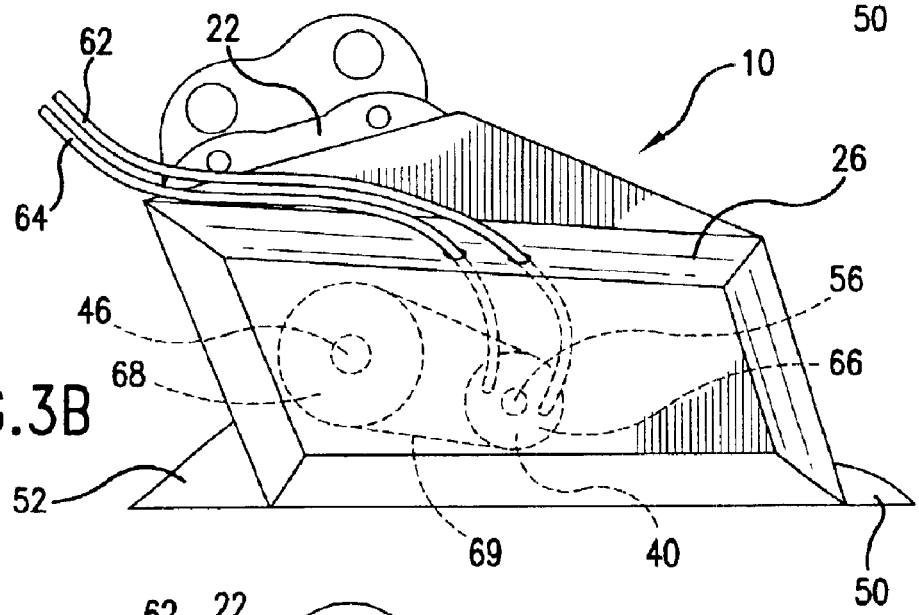
FIG. 3B is a side elevation view of an exemplary embodiment of a mobile impact crusher assembly in accordance with the present invention. The view shows the driving mechanism being a V belt that is connected between two drive pulleys.

FIG. 3B shows an alternate exemplary embodiment of the driving mechanism 40. Here, a hydraulic motor 56 is present on the frame 26 but instead of driving the second rubber tire 60, the hydraulic motor 56 drives a drive pulley 66. Another drive pulley 68 is also present and is in communication with the rotor shaft 46. The drive pulleys 66 and 68 are in communication with one another through a V-belt 69. Rotation of the drive pulley 66 brought about by rotation of the hydraulic motor 56 will cause a corresponding movement of the V-belt 69 around the drive pulley 66. Such motion of the V-belt 69 causes a corresponding motion of the drive pulley 68 which is in contact with the rotor shaft 46 causing rotation of the rotor 32 (as seen in FIGS. 1 and 2). Again, the hydraulic motor 56 need not be present in the exemplary embodiment shown in FIG. 3B. For instance, in other exemplary embodiments of the present invention, an electric motor may be substituted for the hydraulic motor 56 shown in FIG. 3B. Additionally, if a hydraulic motor 56 were to be used, the hydraulics required to run the hydraulic motor 56 may be supplied by an independent hydraulic/diesel system 110 that is present on the frame 26, and is not run from the vehicle into the frame 26 or elsewhere, as shown in FIG. 5.

Figure 3C:
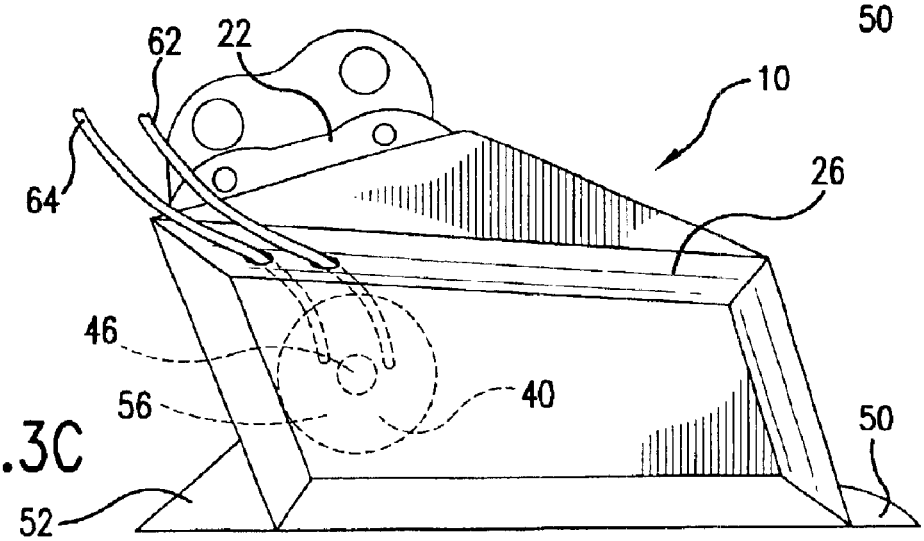
FIG. 3C is a side elevation view of an exemplary embodiment of a mobile impact crusher assembly in accordance with the present invention. The driving mechanism is shown as being a motor coupled directly to a shaft of the rotor.

FIG. 3C shows yet another exemplary alternative embodiment of the driving mechanism 40. Here, the hydraulic motor 56 is directly mounted onto the rotor shaft 46. Hydraulic lines 62 and 64 are again present and are run from the vehicle into the frame 26 and are used to power the hydraulic motor 56. As previously mentioned, the hydraulic motor 56 may be substituted with an electric motor in other exemplary embodiments of the present invention. Further, the hydraulic source may be independently created and housed on the frame 26 or elsewhere as opposed to being supplied from the hydraulics of the vehicle. The direct mounting of the hydraulic motor 56 may be accomplished by various ways known in the art. For instance, the shaft emanating from the hydraulic motor 56 may be coupled onto the rotor shaft 46. In the case of mounting the hydraulic motor 56 directly onto the rotor shaft 46, the RPM of the rotor 32 may be regulated by a hydraulic control value (not shown).

Figure 4A:
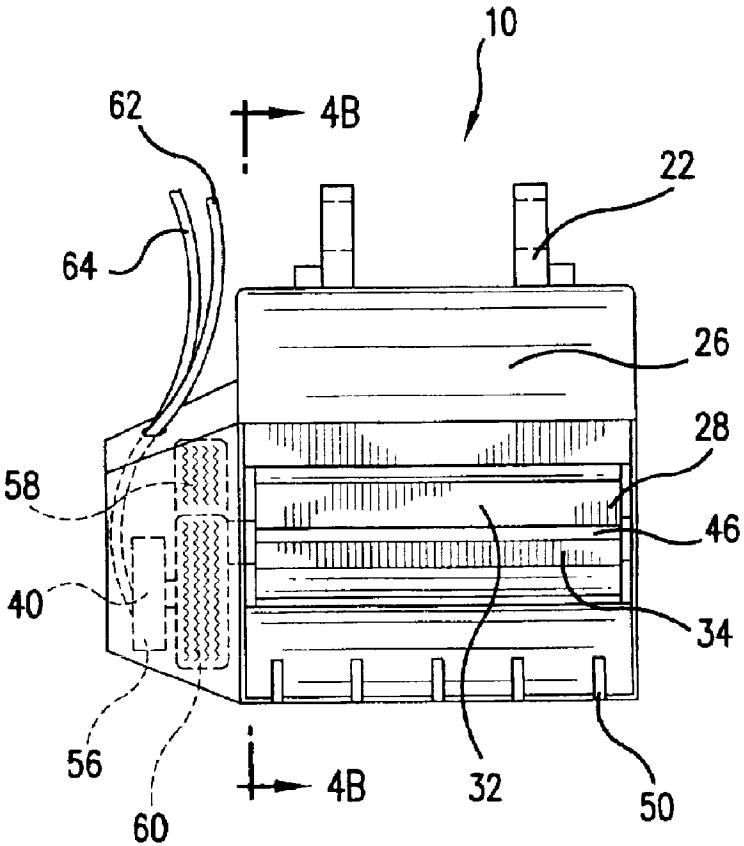
FIG. 4A is a front elevation view of the exemplary embodiment of the mobile impact crusher assembly shown in FIG. 3A.

FIG. 4A shows a front elevation view of the mobile impact crusher assembly 10 having the driving mechanism 40 displayed in FIG. 3A. As can be seen, the driving mechanism 40 is positioned on an end of the frame 26 and is adjacent to the holding section 28. A counter weight (not shown) may be placed on an opposite end from the driving mechanism 40 as is known in the art. Although not shown, a screen may be placed in the opening leading to the holding section 28. Such a screen may help ensure that objects other than those sought to be placed into the holding section 28 are prevented from entering the holding section 28.

Figure 4B:
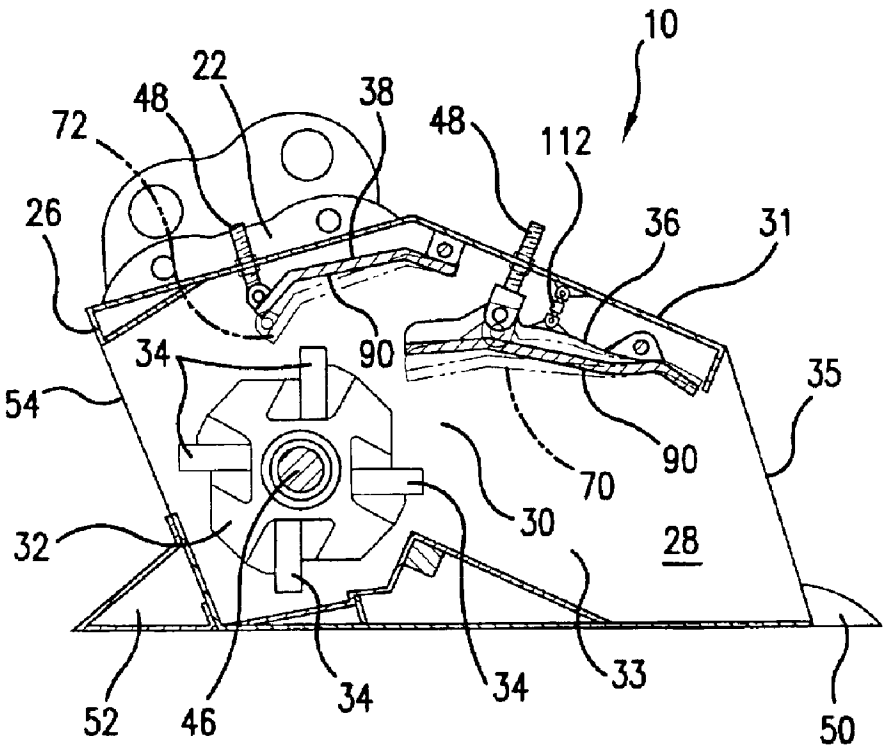
FIG. 4B is a side elevation view of the mobile impact crusher assembly taken along line 4B of FIG. 4A. The view shows the first and second impact plates being adjustable in order to control the size of the reduced objects that are crushed in the mobile impact crusher assembly.

FIG. 4B is a side elevation view taken along line 4B of FIG. 4A. Here, it can be seen that the first impact plate 36 is adjusted to an adjusted position 70, which is schematically indicated by the chain-dashed line representation of the first impact plate 36. Similarly, the second impact plate 38 is shown being moved to an adjusted position 72. The adjusted positions 70 and 72 may be provided in order to vary the output size of the reduced objects 44 (as shown in FIG. 2). Additionally, wear on the hardened surfaces 90 of the first and second impact plates 36 and 38 may require adjustment of the plates 36 and 38 into the adjusted positions 70 and 72 in order to provide for the correct size of the reduced objects 44 (as shown in FIG. 2).

A hydraulic cylinder 112 may be provided on the frame 26 and in engagement with the first impact plate 36. The hydraulic cylinder 112 may be actuated in order to close off and isolate the holding section 28 from the crushing section 30. As such, the rotor 32 may be run, and the hydraulic cylinder may then move the first impact plate 36 so that objects 42 are then hit by the crushing bars 34 of the rotor 32.

Figure 7:
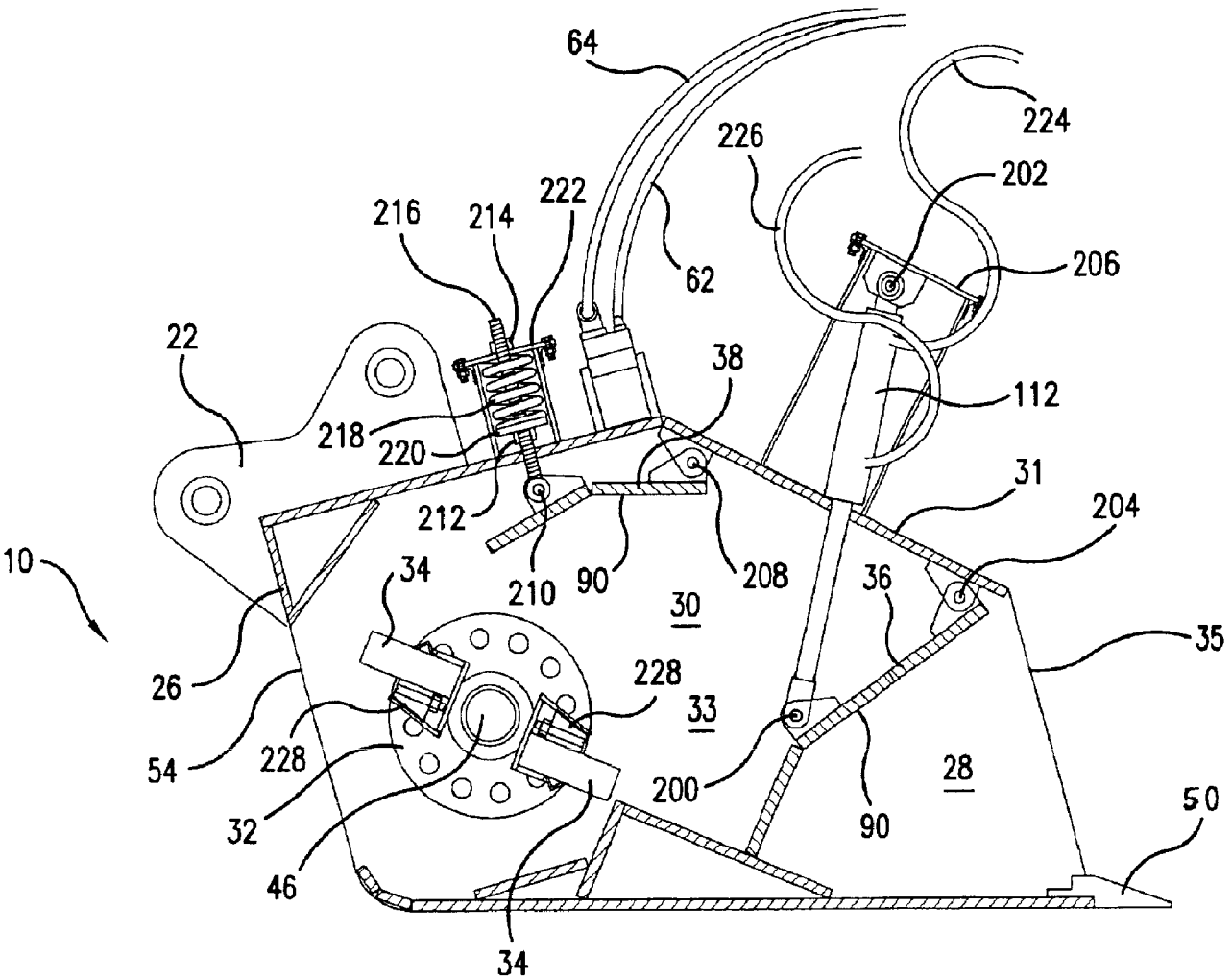
FIG. 7 is a side elevation view of another exemplary embodiment of the mobile impact crusher assembly of the present invention. The view shows a first impact plate being positioned so as to separate a holding section from a crushing section.

An alternative exemplary embodiment of the mobile impact crusher assembly 10 is shown is FIG. 7. Here, the hydraulic cylinder 112 is shown being in an actuated position in which the first impact plate 36 is positioned so as to isolate the holding section 28 from the crushing section 30. This is accomplished by having the hydraulic cylinder 112 being pivotally attached to first impact plate 36 through a pivotal attachment 200. The first impact plate 36 is also pivotally attached to the frame 26 at a pivotal attachment 204. Upon isolation of the holding section 28 from the crushing section 30, the holding section 28 may be used as a bucket as is present on a conventional excavator.

As the hydraulic cylinder 112 extends, the first impact plate 36 is pivoted about the pivotal attachment 204. The hydraulic cylinder 112 is partially housed within a frame extension 206 of the frame 26. Hydraulic fluid is fed into and out of the hydraulic cylinder 112 through hydraulic lines 224 and 226. The hydraulic cylinder 112 is pivotally attached to the frame extension 206 of the frame 26 through a pivotal attachment 202. The pivotal attachment 202 allows the hydraulic cylinder 112 to pivot with respect to the frame 26 during actuation of the hydraulic cylinder 112.

The second impact plate 38 is shown as being pivotally attached to the frame 26 through a pivotal attachment 208. As such, upon being struck by thrown objects 42, the second impact plate 38 will pivot about the pivotal attachment 208. A further pivotal attachment 210 is present on the second impact plate 38 in order to allow a rod 216 to be connected to the second impact plate 38 and pivot with respect thereto. The rod 216 extends through a spring 218 and a frame extension 222 of the frame 26. The, spring 218 engages the frame extension 222 of the frame 26 on one end thereof, and engages a plate 220 on an opposite end.

A limiting member 212 being a first nut 212 is connected to the rod 216 and engages the plate 220. Another limiting member 214 being a second nut 214 is threadably engaged upon the rod 216, the spring 218 being positioned between the first nut 212 and the second nut 214. It is to be understood that in other exemplary embodiments of the present invention, the first and second nuts 212 and 214 may be either threadably connected onto the rod 216 or permanently affixed to the rod 216. Objects 42 that are thrown against the second impact plate 38 impact the hardened surface 90. The force of this impact is transferred through the rod 216 and causes the plate 220 to compress the spring 218. The spring 218 exerts a force in response to the impact, and tends to absorb the force of the impact. The first and second nuts 212, 214 may be adjusted in order to vary the distance of the second impact plate 38 from the frame 26. This adjustment may therefore allow for the regulation of the size and amount of the crushed objects 44 that are discharged from the mobile impact crusher assembly 10. In one exemplary embodiment of the present invention, hydraulic cylinders may be incorporated into both of the first and second impact plates 36, 38 in order to help prevent oversized crushed objects 44 from exiting the mobile impact crusher assembly 10.

Although described as having a threaded engagement, the rod 216 and nuts 212, 214, the spring 218, and related components may be configured with a manual spring style release system that provides for faster adjustment of the second impact plate 38.

The exemplary embodiment of the mobile impact crusher assembly 10 shown in FIG. 7 has the rotor 32 being provided with two crushing bars 34. Each of the crushing bars 34 is affixed to the rotor 32 by way of a wedge 228. The wedge 228 is designed so that the wedge 228 tightens as the centrifugal force due to the rotating rotor 32 increases. In other exemplary embodiments of the present invention, other ways of attaching the rotor 32 and the crushing bars 34 are contemplated. For instance, pins, bolts, or welding may be employed in other exemplary embodiments. Also, in other exemplary embodiments of the present invention the crushing bars 34 may have a curved cross-section instead of a rectangular cross-section. The crushing bars 34 can have a curved section in order to fit into a corresponding curved section in the rotor 32 to provide for attachment of the crushing bars 34 onto the rotor 32.

Figure 8:
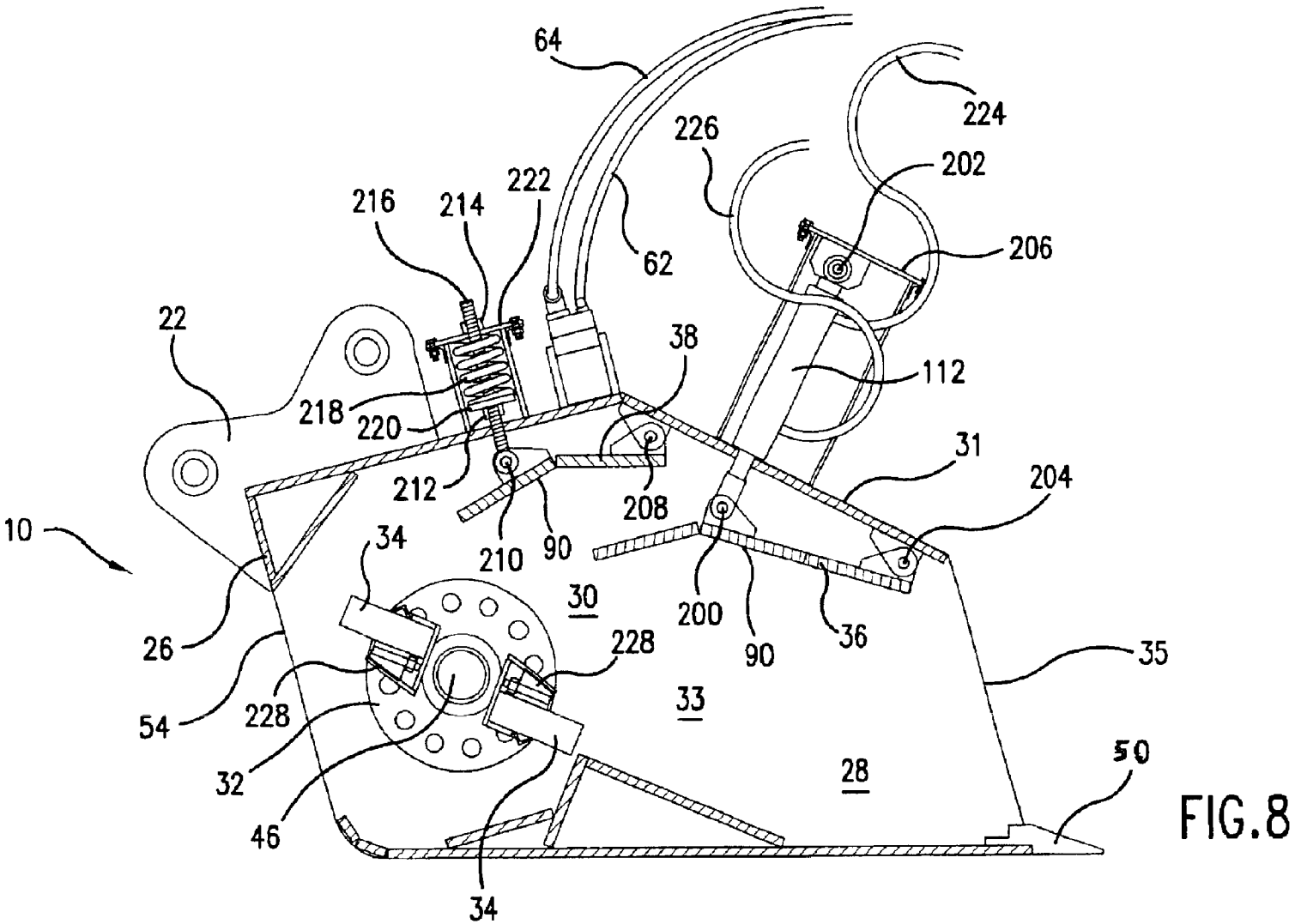
FIG. 8 is a side elevation view of the mobile impact crusher assembly shown in FIG. 7. Here the first impact plate is positioned so that the holding section is no longer isolated from the crushing section.

FIG. 8 shows the mobile impact crusher assembly 10 of FIG. 7 where the hydraulic cylinder 112 has been compressed such that the first impact plate 36 is positioned within the interior space 33 so that the holding section 28 is not isolated from the crushing section 30. During use, the mobile impact crusher assembly 10 may have the first impact plate 36 positioned as shown in FIG. 7 and may be manipulated such that objects 42 are placed within the holding section 28. At this point, the mobile impact crusher assembly 10 may be rotated such that the holding section 28 is for the most part above the crushing section 30. Rotation of the rotor 32 may be started, and once a desired rotational speed is obtained the first impact plate 36 may be swung into the open position as shown in FIG. 8. At this point, objects 42 fall into the crushing section 30 from the holding section 28 and are reduced into the crushed objects 44. This type of an arrangement may be advantages in that the rotor 32 may be prevented from being jammed due to the fact that it is at a fully developed speed before any contact with the objects 42 occurs.

Figure 9:
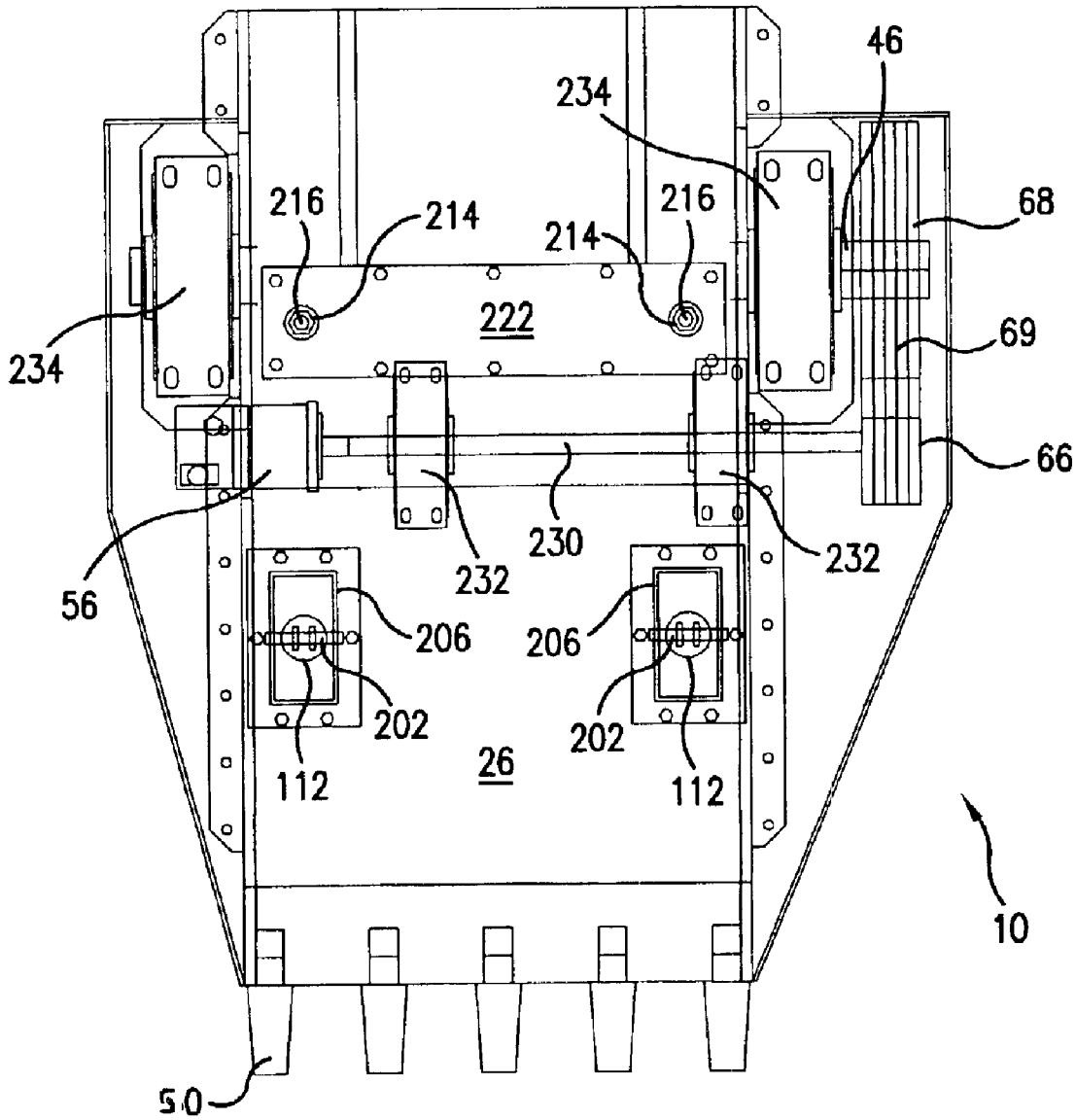
FIG. 9 is a top plan view of the mobile impact crusher assembly shown in FIG. 7.

FIG. 9 is a top view of the mobile impact crusher assembly shown in FIGS. 7 and 8. Here, the motor 56 is a hydraulic motor that is attached to the frame 26. A shaft 230 is coupled to the motor 56 and extends across the frame 26. The shaft 230 is rotationally mounted onto the frame 26 by way of a pair of bearing assemblies 232. The driving mechanism is essentially the same as the driving mechanism 40 as shown in FIG. 3B. Here, a V-belt 69 is employed in order to allow for rotational motion to be transferred from the drive pulley 66 to the drive pulley 68. The drive pulley 66 is connected to the shaft 230 such that rotation of the shaft 230 causes a corresponding rotation of the drive pulley 66. As can be seen, this rotation is then transferred to the drive pulley 68 which is connected to the rotor shaft 46. Here, the rotor shaft 46 is supported by a pair of bearing assemblies 234.

Figure 10:
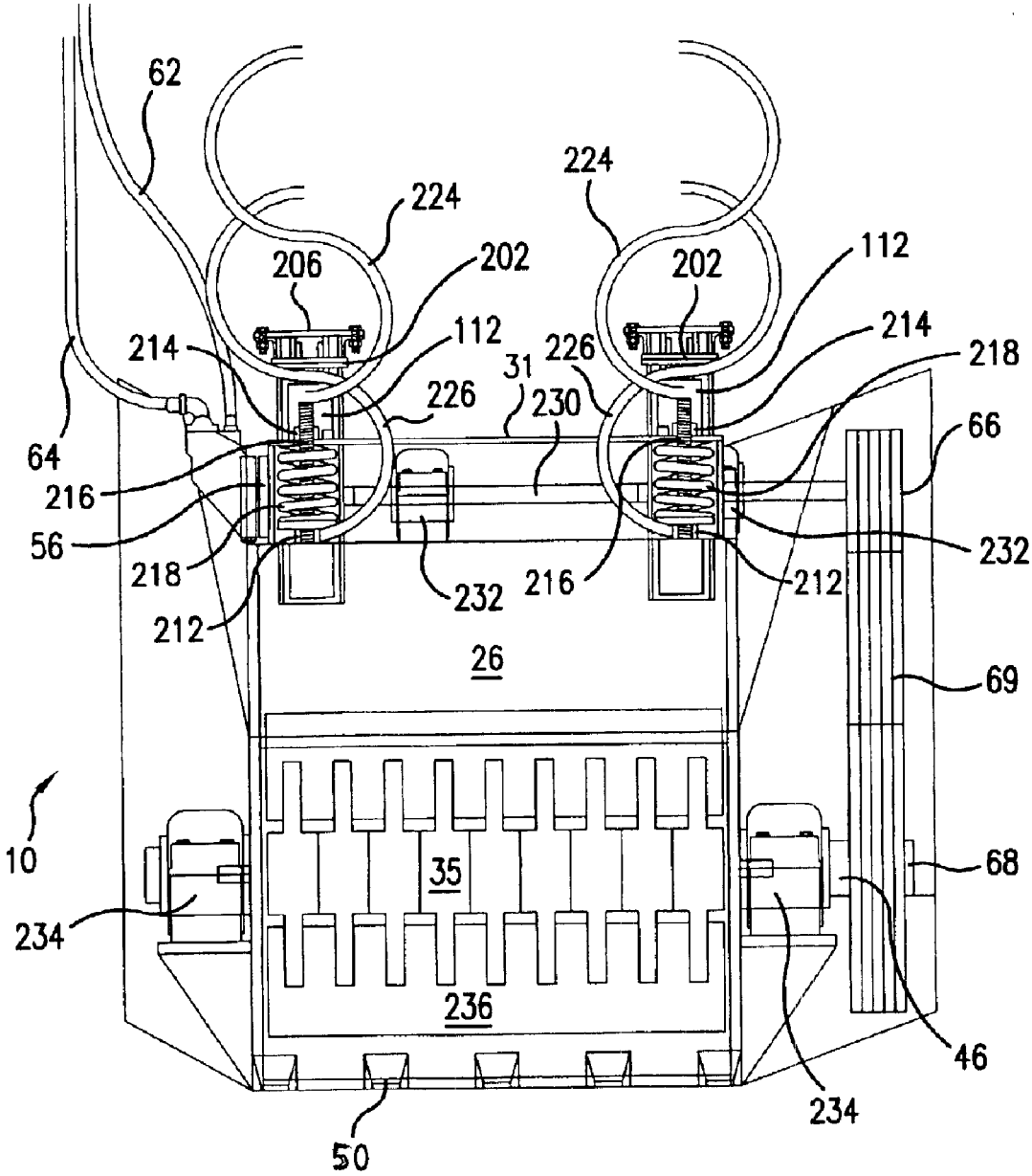
FIG. 10 is a front view of the mobile impact crusher assembly shown in FIG. 7.

FIG. 10 shows a front view of the exemplary embodiment of the mobile impact crusher assembly 10 displayed in FIGS. 7 through 9. Here, a guard 236 is positioned proximate to the inlet opening 35 of the frame 36. The guard 236 may be configured such that objects 42 are only able to enter the mobile impact crusher assembly 10 if they are of a desired size and weight. It is to be understood that in other exemplary embodiments of the present invention, the presence of the guard 236 is not necessary.

Although shown as employing the driving mechanism 40 of FIG. 3B, it is to be understood that in other exemplary embodiments of the present invention drive components other than the V-belt 69 and the drive pulleys 66 and 68 may be employed. Additionally, hydraulic power may be substituted for other forms of power in running the driving mechanism 40 in other exemplary embodiments. An advantage of using a hydraulic driving mechanism 40 is that the hydraulic configuration allows for the reversal of the rotation of the rotor 32. Reversing the rotor 32 will assist in clearing the crushing section 30, referring now to FIG. 7, if large and/or non-crushable objects 42 are present within the crushing section 30.

FIG. 5 shows the mobile impact crusher assembly 10 being connected to a first excavator arm 14 of an excavator 12. The excavator 12 includes a second excavator arm 76 that is attached to the first excavator arm 14. The second excavator arm 76 also has a second hydraulic cylinder 74 being attached thereto and being powered by the diesel/hydraulic system 114 of the excavator 12. Actuation of the second hydraulic cylinder 74 causes a corresponding rotation of the first excavator arm 14 about the second excavator arm 76. As can be seen from this arrangement, it is possible for the excavator 12 to manipulate the mobile impact crusher assembly 10 such that objects 42 are able to be scooped into the frame 26 of the mobile impact crusher assembly 10. The excavator 12 may be moved back and forth on excavator tracks 78. Additionally, the excavator 12 may swivel about the excavator swivel base 79 such that the first excavator arm 14, second excavator arm 76 and the mobile impact crusher assembly 10 are rotated in a direction normal to the side elevational view shown in FIG. 5.

The mobile impact crusher assembly 10 as opposed to simply reducing the size of objects 42, may also act to separate objects. For instance, steel may be separated from the product in which it is encased during a pass through the mobile impact crusher assembly 10. Objects 42 that may be crushed by the mobile impact crusher assembly 10 include rock, rubble, stone, boulders, concrete, asphalt, brick, block, glass, demolition debris and the like.

Figure 6:
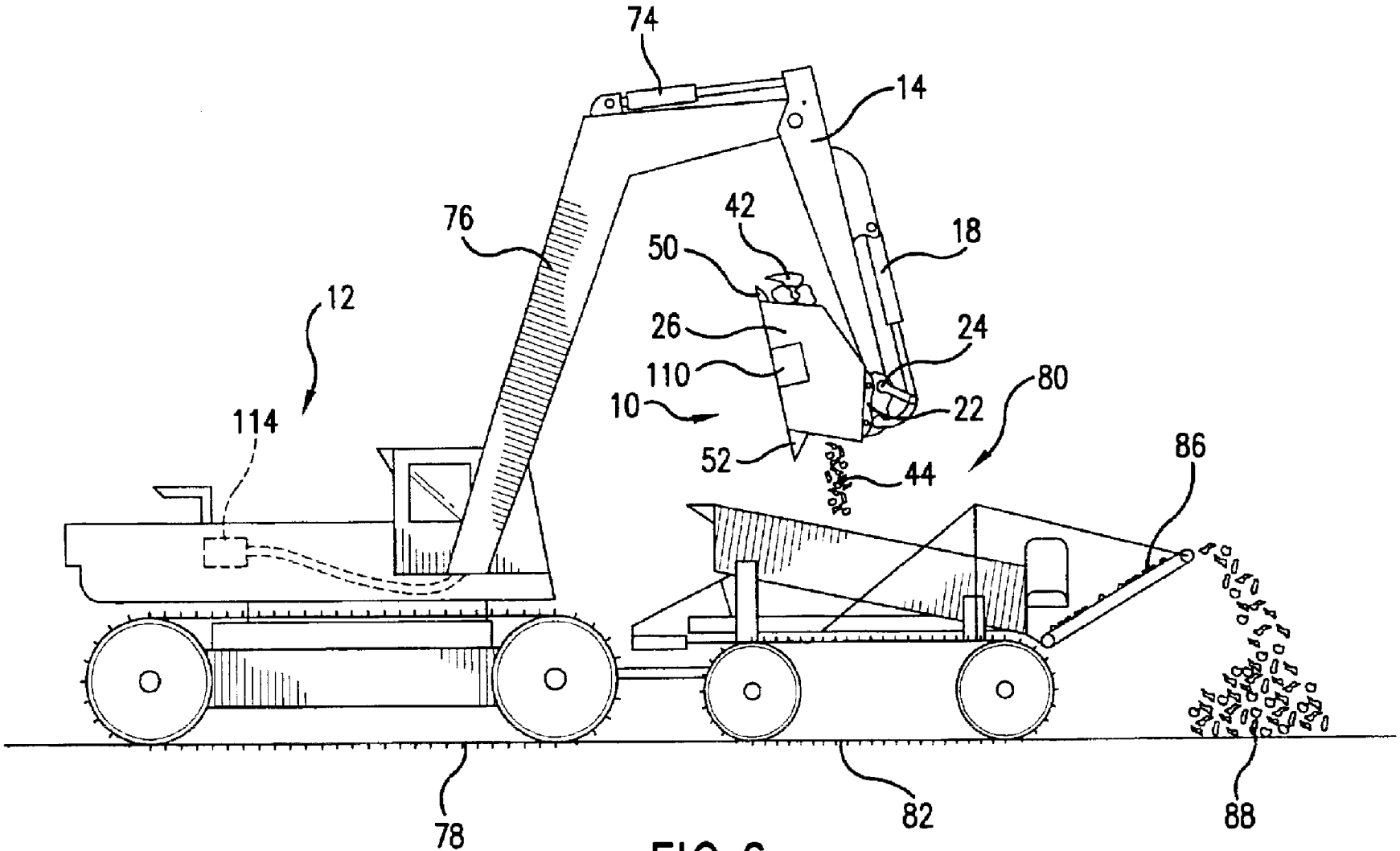
FIG. 6 is a side elevation view of an exemplary embodiment of the mobile impact crusher assembly in accordance with the present invention. The view shows the mobile impact crusher assembly being connected to an arm of an excavator and depositing reduced objects therefrom into a screener. The screener may further reduce the size of the crushed objects and deposit them into a corresponding stock pile.

In one exemplary embodiment of the present invention as shown in FIGS. 5 and 6 for example, a screener 80 is attached to the excavator 12. Such a screener 80 is commonly known in the art, and its purpose is to further reduce or separate material placed into the screener 80. The screener 80 may be provided with screener tracks 82 or tires (not shown) in order to aid in movement of the screener 80. The screener 80 may be run by its own power source, or may be driven via the diesel/hydraulic system 114 of the excavator 12. The screener 80 has a screener input 84 into which objects are deposited. The screener 80 then screens the inputted objects such that only objects of a desired size and/or those exhibiting certain desirable properties are outputted onto the screener output 86. These objects are then subsequentially transferred off of the screener 80 and deposited into a stock pile 88 of screened material. However, in other exemplary embodiments of the present invention, output from the screener output 86 is sent directly to another vehicle which then transports the screened objects to a remote location as opposed to simply depositing the output from the screener output 86 into the stock pile 88.

Since the mobile impact crusher assembly 10 is replacing the bucket of the excavator 12, the operator of the excavator 12 may use the mobile impact crusher assembly 10 to scoop objects 42 to be crushed in much the same way as the operator would when using the normal bucket.

FIG. 6 shows a side elevation view of an exemplary embodiment of the mobile impact crusher assembly 10 in accordance with the present invention. Here, the mobile impact crusher assembly 10 is again attached to an excavator 12 and is shown as being rotationally pivoted on the first excavator arm 14. The mobile impact crusher assembly 10 is in a substantially vertical orientation such that objects 42 are being crushed by the mobile impact crusher assembly 10 and are being expelled into the screener input 84 of the screener 80. At this point, the reduced objects 44 are further processed by the screener 80 such that they are reduced in size and/or sorted according to desired properties. The output from the screener output 86 is deposited into the stock pile 88 of screened material.

It is to be appreciated that the mobile impact crusher assembly 10 may be connected to vehicles other than the excavator 12 in other exemplary embodiments of the present invention as schematically shown in FIG. 1. For instance, the mobile impact crusher assembly 10 may be configured to be attached to a vehicle 13 such as a loader, a shovel, and/or a crane. As such, attachment to only the excavator 12 is not always necessary. It is to be understood that the connection member 22 may be configured such that the mobile impact crusher assembly 10 is engagable with two or more different types of vehicles.

One advantage of the present invention is that the mobile impact crusher assembly 10 is capable of being mounted onto a vehicle as opposed to simply being positioned on the ground. Such a configuration allows for the elimination of an independent power source needed to run the stand-alone impact crusher that is positioned on the ground. Additionally, several steps can be combined or eliminated when the mobile impact crusher assembly 10 is mounted onto an arm of a vehicle. For instance, it is not necessary to load the objects 42 into the stand-alone impact crusher and then retrieve the reduced objects 44 from the crusher.

An additional advantage of the mobile impact crusher assembly 10 as disclosed in the present application is that the mobile impact crusher assembly 10 may produce a desired saleable object by a single pass of the objects 42 through the holding section 28 and the crushing section 30. A saleable object is defined as an object outputted from the mobile impact crusher assembly 10 that is of a desired size, and in which no other machinery is needed to place the object into the mobile impact crusher assembly 10 or remove the reduced object therefrom. It is the case that current impact crushers are used for the purpose of reducing the objects 42 into reduced objects 44 which are then required to be further processed in order to achieve objects of the desired size. In essence, current impact crushers are preparation crushers and are not capable of producing saleable objects of the desired size. However, at least one exemplary embodiment of the present invention allows for saleable objects to be realized upon departing the discharge opening 54 through a single pass of the objects 42 through the holding section 28 and the crushing section 30. It is also to be understood that in other exemplary embodiments of the present invention, the mobile impact crusher assembly 10 can be used in a preparation stage in reducing the objects 42. As shown in FIGS. 5 and 6 for example, the reduced objects 44 are further processed by the screener 80.

Significant savings can be realized if a single diesel/hydraulic system 114 is used on the excavator 12 and also powers the mobile impact crusher assembly 10 as opposed to two separate diesel/hydraulic systems, one being for the excavator 12 and the other for a stand-alone impact crusher. Further savings can also be realized in the exemplary embodiment shown in FIGS. 5 and 6 if the single diesel/hydraulic system 114 is also used to power the screener 80.

It is therefore the case, that the present invention may eliminate the need for an elaborate hopper/feeder/crusher/conveyor system. The mobile impact crusher assembly 10 may utilize the holding section 28 as a hopper and feeder. By lifting and tilting the mobile impact crusher assembly 10 at the same time, the reduced objects 44 simply discharge at a desired height from the mobile impact crusher assembly 10 to create a stock pile without the use of a conveyor. When mounted on the excavator 12, the excavator 12 can swivel about the excavator swivel base 79 anywhere in a 360° circumference to deposit reduced objects 44. This allows for multiple piles of the reduced objects 44 to be stock piled without moving the excavator 12 via the excavator tracks 78.

The screen 80 may be mounted on the screener tracks 82 or simply mounted on tires (not shown) while being towed. Additionally, the screener 80 may have its own source of power in order to provide its own mobility as opposed to being simply towed by the excavator 12. As can be seen, the present invention encompasses exemplary embodiments where the screener 80 is an independent vehicle from the excavator 12 and has its own power source, and also encompasses exemplary embodiments where the screener 80 and the excavator 12 are essentially one vehicle, each sharing their own power source.

In one exemplary embodiment of the present invention, the screener 80 is towed by the excavator 12 and is powered by the same power source which runs the excavator 12. The excavator 12 may use the mobile impact crusher assembly 10 to scoop a load of objects 42 to be crushed. Once material is within the frame 26 of the mobile impact crusher assembly 10, the excavator 12 may be rotated 180° in order to position the mobile impact crusher assembly 10 directly over the screener input 84. Reduced objects 44 are discharged from the mobile impact crusher assembly 10 into the screen 80 for sizing purposes. The entire system, that being the excavator 12 along with the screener 80 may move forward using the tracks on the excavator 12 while digging, scooping, loading, crushing, screening, and then stock piling the screened material into the stock pile 88. As can be seen, the mobile impact crusher assembly 10 is attached to the excavator 12, and the screener 80 and may be capable of performing all of the various necessary tasks while the entire assembly is moving in any direction.

It should be understood that the present invention includes various modifications that can be made to the embodiments of the mobile impact crusher assembly 10 described herein as come within the scope of the appended claims and their equivalents.

What is claimed is:

1. A mobile impact crusher assembly for crushing objects, comprising:

a frame defining an enclosure with an exterior surface and an interior space, an inlet opening to said space and an outlet opening disposed generally opposite said inlet opening, said frame defining a holding section of said interior space and adjacent said inlet opening, said frame defining a crushing section of said interior space and communicating with said holding section and said outlet opening;

a connection member configured for pivotal attachment to a vehicle, said connection member being carried by said exterior surface of said frame;

a rotor rotationally mounted relative to said frame and disposed in said interior space;

at least a first crushing bar carried by said rotor;

at least a first impact plate carried by said frame, wherein said first impact plate is selectively positionable so as to be capable of being positioned between said holding section and said crushing section;

a driving mechanism in communication with said rotor to rotate said rotor; and wherein said connection member is configured so as to permit said frame to be manipulated by the vehicle in order for objects to pass through said inlet opening into said holding section, and further manipulated by the vehicle in order to discharge crushed objects out of said outlet opening of said frame.

2. The mobile impact crusher assembly of claim 1, wherein said driving mechanism is configured to be run by a hydraulic source of the vehicle.

3. The mobile impact crusher assembly of claim 1, wherein the object is crushed by said mobile impact crusher assembly into a saleable product by a single pass through said holding section and said crushing section.

4. The mobile impact crusher assembly of claim 1, wherein the object is crushed by said mobile impact crusher assembly into a reduced size for further processing.

5. The mobile impact crusher assembly of claim 1, wherein:

at least four crushing bars are carried on said rotor; and at least a second impact plate carried by said frame are at least two in number and disposed in relation to said at least one crushing bar of said rotor such that objects being struck by said at least one crushing bar are thrown more likely then not against at least one of said impact plates.

6. The mobile impact crusher assembly of claim 1, further comprising a diesel/hydraulic system attached to said frame and separate from the vehicle and configured to operate said driving mechanism to drive said rotor.

7. The mobile impact crusher assembly of claim 1, wherein said driving mechanism comprises a hydraulic motor directly coupled to said rotor.

8. The mobile impact crusher assembly of claim 1, wherein said driving mechanism comprises a drive pulley in communication with a shaft engaging said rotor in order to rotate said shaft, said drive pulley being driven by a motor selected from the group consisting of an electric motor, an internal combustion motor, and a hydraulic motor.

9. The mobile impact crusher assembly of claim 1, wherein said driving mechanism comprises a first frictional engaging member in communication with said rotor, rotation of said first frictional engaging member causes said rotor to rotate, and a second frictional engaging member engaging said first frictional engaging member so that rotation of said second frictional engaging member causes said first frictional engaging member to rotate.

10. The mobile impact crusher assembly of claim 1, wherein said at least one impact plate is selectively adjustable to adjust the distance between said at least one impact plate and said rotor.

11. The mobile impact crusher assembly of claim 1, wherein said connection member of said frame is configured for attachment to a vehicle that is selected from the group consisting of a hydraulic excavator, a loader, a shovel, and a crane.

12. The mobile impact crusher assembly of claim 1, further comprising a screen attachment attached to the vehicle so that crushed objects from said mobile impact crusher assembly can be deposited into said screen attachment for further processing.

13. The mobile impact crusher assembly of claim 12, wherein said screen attachment is mounted on tracks and is run by a power source of the vehicle selected from the group consisting of a hydraulic power source, an internal combustion power source, and an electric power source.

14. The mobile impact crusher assembly of claim 1, further comprising a hydraulic cylinder attached to said frame and engaging said first impact plate in order to reposition said first impact plate in order to isolate said crushing section from said holding section.

15. The mobile impact crusher assembly of claim 1, further comprising:

a spring engaging said frame on one end of said spring;

a rod pivotally attached on one end to said at least one impact plate, said rod extending through said spring; and a pair of limiting members carried on said rod, said spring being disposed between said limiting members.

16. A mobile impact crusher assembly for crushing objects, comprising:

a frame defining an enclosure with an exterior surface and an interior space, said interior space defining a holding section and a crushing section and configured for attachment to a vehicle capable of moving said frame and at least partially rotating said frame, said frame having an inlet opening to accept objects therein and having an outlet opening to allow crushed objects to be removed from said frame;

a rotor rotationally mounted relative to said frame, said rotor configured to be rotated for crushing objects held in said frame; and at least a first impact plate carried by said frame, wherein said first impact plate is selectively positionable so as to be capable of being positioned between said holding section and said crushing section.

17. The mobile impact crusher assembly of claim 16, wherein said rotor is powered by a hydraulic source of the vehicle.

18. The mobile impact crusher assembly of claim 16, wherein the object is crushed by said mobile impact crusher assembly into a saleable product by a single pass through said frame.

19. The mobile impact crusher assembly of claim 16, wherein the object is crushed by said mobile impact crusher assembly into a reduced size for further processing.

20. The mobile impact crusher assembly of claim 16, further comprising:

two impact plates carried by on said frame;

a driving mechanism carried by said frame and connected to said rotor for driving said rotor to rotate said rotor; and a plurality of crushing bars located on said rotor, and configured for striking the objects and throwing the objects against said impact plates to at least partially crush the objects.

21. The mobile impact crusher assembly of claim 20, further comprising a hydraulic cylinder attached to said frame and engaging said first impact plate in order to reposition said first impact plate to isolate said crushing section from said holding section.

22. The mobile impact crusher assembly of claim 20, further comprising:

a spring engaging said frame on one end of said spring;

a rod pivotally attached on one end to one of said impact plates, said rod extending through said spring; and a pair of limiting members carried on said rod, said spring being disposed between said limiting members.

23. The mobile impact crusher assembly of claim 16, further comprising a diesel/hydraulic system attached to said frame and separate from the vehicle and configured to cause rotation of said rotor.

24. The mobile impact crusher assembly of claim 16, further comprising:

a shaft extending from the rotational center of said rotor, wherein rotation of said shaft causing rotation of said rotor; and a hydraulic motor directly coupled to said shaft, said hydraulic motor causing rotation of said shaft.

25. The mobile impact crusher assembly of claim 16, further comprising:

a shaft extending from the rotational center of said rotor, rotation of said shaft causing rotation of said rotor;

a drive pulley in communication with said shaft, wherein rotation of said drive pulley causing rotation of said shaft; and a motor selected from the group consisting of an electric motor and a hydraulic motor, said motor connected in communication with said drive pulley to drive said drive pulley.

26. The mobile impact crusher assembly of claim 16, further comprising:

a first frictional engaging member in communication with said rotor, wherein rotation of said first frictional engaging member causing said rotor to rotate; and a second frictional engaging member engaging said first frictional engaging member, wherein rotation of said second frictional engaging member causing said first frictional engaging member to rotate.

27. A mobile impact crusher assembly of claim 20, wherein each of said two impact plates is adjustable to adjust the distance between each of said two impact plates and said rotor.

28. The mobile impact crusher assembly of claim 16, wherein said frame is configured for attachment to a vehicle that is selected from the group consisting of a hydraulic excavator, a loader, a shovel, and a crane.

29. The mobile impact crusher assembly of claim 16, further comprising a screen attachment attached to the vehicle, wherein crushed objects from said mobile impact crusher assembly can be deposited into said screen attachment for further processing.

30. The mobile impact crusher assembly of claim 29, wherein said screen attachment is mounted on tracks and is configured to be run by a power source of the vehicle selected from the group consisting of a hydraulic power source and an electric power source.

* * * * *